US011340039B2

(12) United States Patent
Posada et al.

(10) Patent No.: US 11,340,039 B2
(45) Date of Patent: May 24, 2022

(54) CARTRIDGE BREECH PLUG FOR INLINE MUZZLE LOADING FIREARM

(71) Applicants: Esteban Gonzalez Posada, Medellin (CO); Camilo Restrepo Restrepo, Medellin (CO)

(72) Inventors: Esteban Gonzalez Posada, Medellin (CO); Camilo Restrepo Restrepo, Medellin (CO)

( * ) Notice: Subject to any disclaimer, the term of this patent is extended or adjusted under 35 U.S.C. 154(b) by 0 days.

(21) Appl. No.: 16/285,814

(22) Filed: Feb. 26, 2019

(65) Prior Publication Data

US 2020/0271411 A1 Aug. 27, 2020

(51) Int. Cl.
*F41C 9/08* (2006.01)
*F41A 3/74* (2006.01)

(52) U.S. Cl.
CPC . *F41C 9/08* (2013.01); *F41A 3/74* (2013.01)

(58) Field of Classification Search
CPC .. F41A 21/12; F41A 21/00; F41C 9/08; F41C 9/085
USPC ..... 42/51
See application file for complete search history.

(56) References Cited

U.S. PATENT DOCUMENTS

| | | | | |
|---|---|---|---|---|
| 173,476 | A | 2/1876 | Ladd | |
| 2,352,476 | A | 6/1944 | French | |
| 2,869,127 | A | 1/1959 | Williams | |
| 2,898,694 | A | 8/1959 | Senutovitch | |
| 3,156,995 | A | 11/1964 | Mellor et al. | |
| 3,196,569 | A | 7/1965 | Thomason | |
| 4,128,040 | A | 12/1978 | Schuetz | |
| 4,222,191 | A | 9/1980 | Lee et al. | |
| 4,227,330 | A | 10/1980 | Chapin | |
| 4,232,468 | A | 11/1980 | Chapin | |
| 4,437,249 | A * | 3/1984 | Brown | F41C 9/08 42/51 |
| 4,700,499 | A | 10/1987 | Knight | |
| 5,511,334 | A * | 4/1996 | Ball | F41C 9/08 42/51 |
| 5,561,934 | A | 10/1996 | Knight | |
| 5,623,779 | A | 4/1997 | Rainey, III | |
| 5,642,583 | A * | 7/1997 | Ball | F41C 9/08 42/51 |
| 5,706,598 | A * | 1/1998 | Johnston | F41C 9/08 42/51 |
| 5,729,927 | A | 3/1998 | Shaver, Jr. | |
| 6,029,385 | A | 2/2000 | Howell, Jr. | |
| 6,176,030 | B1 * | 1/2001 | Ball | F41C 9/08 42/51 |
| 6,314,670 | B1 | 11/2001 | Rodney, Jr. | |
| 7,059,074 | B1 | 6/2006 | Calvete Zumalde | |
| 7,243,589 | B2 | 7/2007 | Ireland et al. | |
| 8,079,167 | B1 | 12/2011 | Overstreet | |
| 9,080,830 | B2 | 7/2015 | Hendricks et al. | |
| 9,329,003 | B2 | 5/2016 | Peterson et al. | |

(Continued)

FOREIGN PATENT DOCUMENTS

GB 201527 A 4/1924

*Primary Examiner* — Jonathan C Weber
(74) *Attorney, Agent, or Firm* — Jones Walker LLP

(57) ABSTRACT

A breech plug for inline muzzle loading firearms configured to use a blank powder cartridge loaded from the breech end, rather than powder loaded from the muzzle, and configured to place the projectile in substantially the same location in the barrel as if powder had been loaded from the muzzle end.

17 Claims, 8 Drawing Sheets

(56) References Cited

U.S. PATENT DOCUMENTS

| | | | | |
|---|---|---|---|---|
| 9,546,844 | B2 | 1/2017 | Hall et al. | |
| 9,752,847 | B2 * | 9/2017 | Steele | F41C 9/085 |
| 9,903,676 | B2 | 2/2018 | Calvete et al. | |
| 10,030,956 | B2 | 7/2018 | Peterson, Sr. et al. | |
| 2002/0035800 | A1 | 3/2002 | Lewis | |
| 2002/0129531 | A1 | 9/2002 | Camp | |
| 2005/0183318 | A1 | 8/2005 | McGivern | |
| 2006/0026881 | A1 | 2/2006 | Watley | |
| 2006/0086029 | A1 | 4/2006 | Kirkpatrick | |
| 2006/0248771 | A1 | 11/2006 | Richards | |
| 2007/0137084 | A1 | 6/2007 | Laney et al. | |
| 2007/0163162 | A1 | 7/2007 | Laney et al. | |
| 2008/0282596 | A1 | 11/2008 | DeLeeuw | |
| 2009/0265973 | A1 | 10/2009 | Calvete Zumalde | |
| 2011/0185614 | A1 | 8/2011 | Laney et al. | |
| 2012/0240440 | A1 | 9/2012 | Phair | |
| 2014/0090284 | A1 * | 4/2014 | Peterson | F41C 9/08<br>42/51 |
| 2014/0090285 | A1 * | 4/2014 | Peterson | F41C 7/11<br>42/51 |
| 2016/0273872 | A1 * | 9/2016 | Steele | F41C 9/085 |
| 2017/0307347 | A1 * | 10/2017 | Peterson, Sr. | F41C 9/085 |
| 2018/0259291 | A1 | 9/2018 | Horak | |
| 2018/0321022 | A1 * | 11/2018 | Peterson | F41A 9/375 |

* cited by examiner

CARTRIDGE BREECH PLUG FOR INLINE MUZZLE LOADING FIREARM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to inline muzzle loading firearms; and more specifically relate to converting an inline muzzle-loading firearm to use a pre-packaged powder cartridge.

Description of the Related Art

A muzzling loading firearm requires that both powder and projectile be loaded into the barrel from the muzzle end, rather than from the breech end. To accomplish muzzle loading, a ramrod configured for a particular firearm is used to pack the gunpowder, such as loose black powder. These types of guns, are used for hunting and target shooting, and are modern versions of the muskets of the last century.

Modern muzzle-loaded and closed-breech firearms typically have a mechanically secured plug at the breech end of the barrel configured to house the ignition cap or primer, to allow the gunpowder and projectile to be packed in the barrel, and to contain the pressure generated by the ignition of the gunpowder.

In general, all conventional breech plugs fulfill the same three functions of supporting the primer, communicating the ignition spark to the gunpowder, and containing the pressure generated by the gunpowder. For example, United States Patent Application Publication No. 2009/0265973 discloses "a quick-assembly breech plug for muzzleloader firearms, allowing a quick assembly and disassembly and being extremely practical, simple to manufacture and having a low cost, wherein said breech plug comprises a cylindrical body (1) configured to be internally coupled in a rear end (10') of a barrel (10), and a head (6) configured to define a limit coupling position of the breech plug inside the barrel (10), wherein the cylindrical body (1) externally comprises a male thread (2) having at least two starts located close to a front end (3) of the breech plug, opposite the head (6), according to a plane perpendicular to an axis of revolution of the cylindrical body (1), said male thread (2) being configured to screw into a female thread (10") located internally in the rear end (10') of the barrel (10), preferably 4 screw ridges."

United States Patent Application No. 2006/0086029 discloses "a method and system of loading an in-line muzzle-loading firearm. A projectile is rammed into a muzzle end of a barrel of the in-line muzzle-loading firearm such that a bottom portion of the projectile is adjacent or in close proximity with the breech end of a breech plug. A pre-measured powder cartridge is then inserted within a cartridge receiving bore of the breech plug such that a forward end of the pre-measured powder cartridge is adjacent a bottom portion of the projectile and a rim of the cartridge engages a first annular lip of the breech plug. The cartridge may then be secured within the breech plug by action of a bolt mechanism or a break open receiver mechanism."

U.S. Pat. No. 9,329,003 discloses "a pre-packaged propellant charge and primer for providing efficient loading and unloading of the muzzleloader. The breech end accepts the propellant and means are provided to prevent breech loading of the projectile. A propellant cartridge conforms to a constriction portion to minimize ullage. A projectile is inserted in the muzzle end seats on the constriction portion. The propellant cartridge may be received in a removable breech plug. The constriction portion may be part of the breech plug or a separate component secured in the barrel by way of the breech plug. The cartridge may have a primer mechanism integrated into a proximal end. Projectiles have sliding components that have an axial elongate position and an axial shortened position and may be loaded with a ramrod having an engagement portion for each of the two pieces whereby the projectile doesn't prematurely collapse."

U.S. Pat. No. 9,546,844 discloses "[a] muzzleloader firearm is converted into a firearm adapted for firing an arrow. The stock assembly of the muzzleloader firearm is retained while the barrel assembly is completely removed, and replaced by an arrow barrel assembly. The arrow barrel assembly has a stock assembly attachment for releasably engaging the stock assembly of the muzzleloader firearm, and a barrel attachment for engaging an inner barrel tube that holds an arrow shaft with a hollow interior and propels the arrow out of the firearm when a blank cap is activated, and an outer shroud to protect the inner barrel tube and enclose a loaded arrow. The arrow barrel assembly rearward end has formed recesses for receiving the blank cap and aligning the rim of the blank cap with the firing pin of the muzzleloader stock assembly."

U.S. Pat. No. 9,903,676 discloses "[a]n ammunition system and associated ammunition for firearms, particularly for muzzleloader firearms, having a predetermined amount of propellant charge housed in a casing, and a separate projectile having a sabot. The casing has a cap sealing the casing muzzle end such that the cap and the sabot provide seals to trap propellant gases within the barrel behind the projectile upon firing. The cap top end and sabot bottom end interlock in mechanical communication with one another upon firing allowing the projectile exiting the barrel muzzle end to be responsive to the barrel rifling. The barrel breech end has a chamber bushing for receiving the casing and a tapered muzzle end to prohibit the projectile from entering the casing."

U.S. Pat. No. 10,030,956 discloses "[m]uzzleloader systems include a pre-packaged propellant charge and primer for providing efficient loading and unloading of the muzzleloader. The muzzleloader accepts in the breech end the propellant containment vessel that abuts against a constriction portion with a reduced diameter portion. The propellant containment vessel having an end portion with a tapered surface that conforms to the constriction portion surface. A projectile is inserted in the muzzle end and seats against the constriction portion. The propellant containment vessel may be received in a removable breech plug. The constriction portion may be part of the breech plug or a separate component secured in the barrel by way of the breech plug. The containment vessel further comprises a primer mechanism that may be integrated into the proximal end of the containment vessel."

The inventions disclosed and taught herein are directed to an improved removable breech plug for inline muzzle loading firearms and methods of use not previously contemplated.

BRIEF SUMMARY OF THE INVENTION

As a brief, non-limiting summary of one of the many possible embodiments of a breech plug for modifying an inline muzzle-loading firearm having a barrel, and where the barrel has a predetermined projectile location when the barrel is muzzle loaded with powder, the breech plug may comprise a plug body having a proximal end and a distal end. The proximal end may have an aperture configured to receive a blank powder cartridge. The distal end may be configured with a diverging propulsion gas nozzle, and may have an end portion configured to contact a projectile. A channel may extend from the aperture to the diverging nozzle and may be configured to communicate propulsion gases from the cartridge to the end portion of the diverging nozzle. The body may have an axial length such that when the projectile contacts the end portion of the diverging nozzle, the projectile is located in the barrel at substantially the same predetermined projectile location.

As a brief, non-limiting summary of another embodiment of a modified inline muzzle-loading firearm, the firearm may comprise a barrel with a predetermined projectile location within the barrel when the barrel is muzzle loaded with powder. A removable breech plug may have a body with a proximal end and a distal end. The proximal end may have an aperture configured to receive a blank powder cartridge. The distal end may be configured with a diverging propulsion gas nozzle, and may have an end portion configured to contact a projectile. A channel may extend from the aperture to the diverging nozzle and may be configured to communicate propulsion gases from the cartridge to the end portion of the diverging nozzle. The body may have an axial length such that when the projectile contacts the end portion of the diverging nozzle, the projectile is located in the barrel at substantially the same predetermined projectile location. A gas seal may be disposed between the body and an inside surface of the barrel.

Any embodiments of the inventions disclosed herein may comprise a gas seal configured to seal between the body and an inside surface of the barrel. The seal may comprise an elastomeric O-ring, and may further comprise an O-ring groove adjacent the distal end of the body. The breech plug may be configured to accept a center fire blank powder cartridge. The breech plug may be configured to accept a rim fire blank powder cartridge. The channel may be located about a centerline of the body and the aperture may be offset from the centerline. The plug may be clocked relative to the barrel such that the aperture is located at a hammer strike position. A relief may be provided adjacent the aperture and configured to facilitate removal of a cartridge from the aperture. A projectile stop may be located between the aperture and the channel A removable head may be provided having a firing pin centered about the aperture when the removable head is attached to the proximal end of the body. The removable head may comprise a plurality of channels configured to engage a plurality of lugs on the proximal end of the body to secure the head to the body.

A brief, non-limiting summary of one of the many possible embodiments of a method of adjusting the energy of an inline an inline muzzle loading firearm may involve providing a modified breech plug that may comprise a plug body having a proximal end and a distal end. The proximal end may have an aperture configured to receive a blank powder cartridge. The distal end may be configured with a diverging propulsion gas nozzle. The nozzle may have an end portion configured to engage a projectile, and a channel extending from the aperture to the diverging nozzle and configured to communicate propulsion gases from the cartridge to the end portion of the diverging nozzle. Installing the modified breech plug in the firearm. Selecting a first blank powder cartridge having predetermined energy characteristics configured to provide the firearm with a desired amount of energy for expelling a projectile. Then, inserting the first blank powder cartridge in the modified breech plug.

Such method may also comprise selecting a second blank powder cartridge having predetermined energy characteristics different than the first blank powder cartridge. Then, inserting the second blank powder cartridge in the modified breech plug. Selecting the first blank powder cartridge may comprise selecting a blank powder cartridge that will produce an energy level in the firearm that mimics the energy level of a compressed gas weapon.

None of these brief summaries of the inventions is intended to limit or otherwise affect the scope of the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the present specification and are included to demonstrate further certain aspects of the present inventions. The inventions may be better understood by reference to one or more of these figures in combination with the detailed description presented herein.

Figure 1:
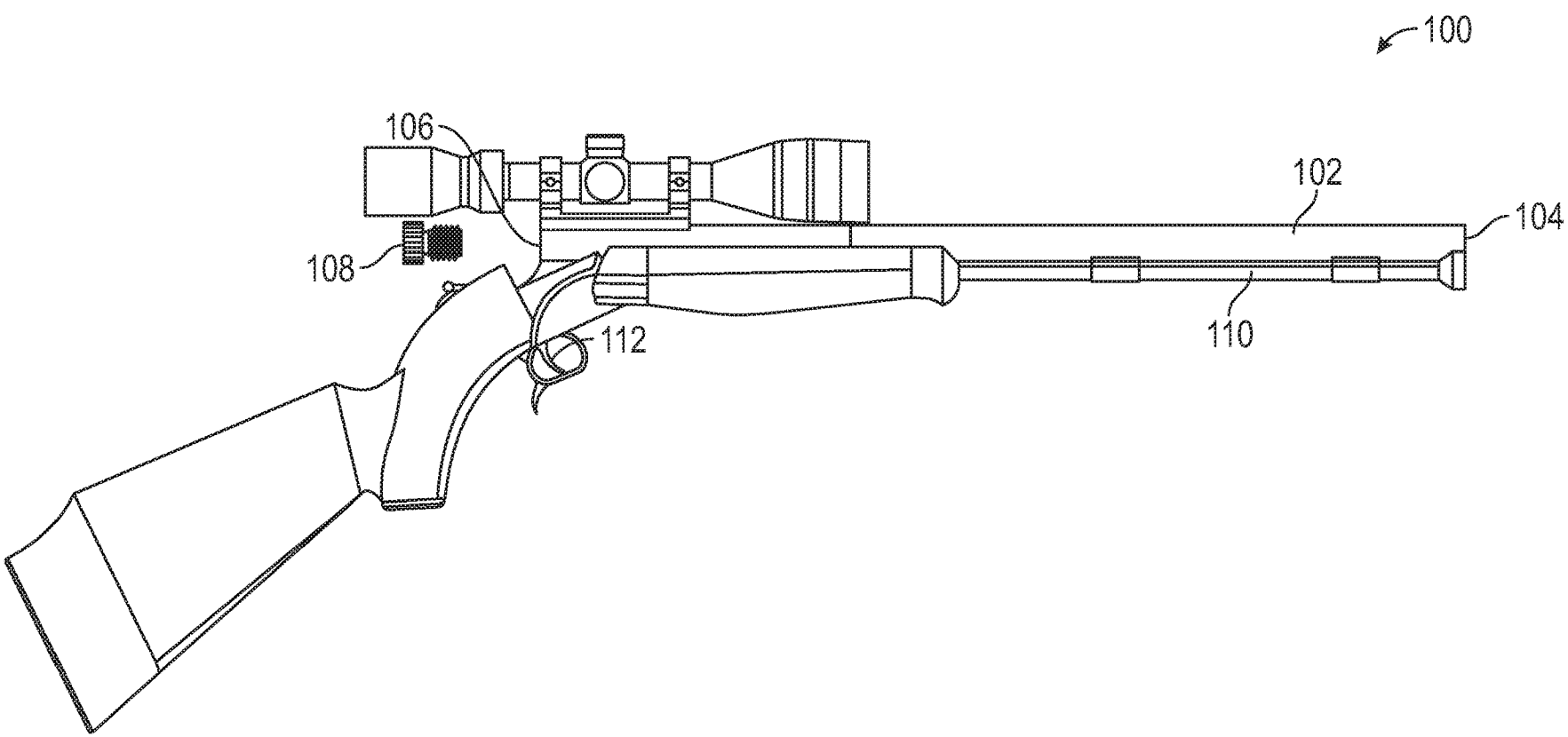
FIG. 1 (Prior Art)
FIG. 1 illustrates an inline muzzle-loading rifle with a conventional removable breech plug.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

In general terms, we have invented a modified breech plug for conventional inline muzzle loading firearms, and also a method of adjusting the energy level of for conventional inline muzzle loading firearms, and also a modified inline muzzle loading firearm, as wells as other inventions disclosed herein. For example, and not limitation, a breech plug for modifying an inline muzzle loading firearm may comprise a plug body having a proximal end and a distal end. The proximal end may have an aperture configured to receive a blank powder cartridge. The distal end may be configured with a diverging propulsion gas nozzle, and may have an end portion configured to contact, engage or seat a projectile. A channel may extend from the aperture to the nozzle, and may be configured to communicate propulsion gases from the cartridge to the end portion of the nozzle. The body may have an axial length such that when the projectile engages the end portion of the diverging nozzle, the projectile is located in the barrel at substantially the same location as when powder has been loaded from the muzzle end of the firearm. The breech plug may further comprise a gas seal configured to seal between the body and an inside surface of the barrel. The seal may comprise an elastomeric O-ring. An O-ring groove may be located adjacent the distal end of the body. The breech plug may be configured to accept a center fire blank powder cartridge or a rim fire blank powder cartridge. For rim fire blank powder cartridges, the channel may be located about a centerline of the body, and the aperture may be offset from the centerline. For rim fire breech plugs, or any breech plug in which the cartridge is off-center, the cartridge aperture should be located in the region of hammer strike when the breech plug is fully seated in the barrel. For example, but not limitation, the rim fire breech plug may be clocked relative to the barrel such that the aperture is located at substantially a 12 o'clock position. It will be appreciated that the off-center distance of the cartridge aperture may be dependent on the particular characteristics (e.g., hammer strike) of a particular fire arm The breech plug may comprise a relief adjacent the aperture configured to facilitate removal of a cartridge from the aperture. The breech plug may comprise a projectile stop located between the aperture and the channel. The breech plug may comprise a removable head having a firing pin centered about the aperture when the removable head is attached to the proximal end of the body. The removable head may comprise a plurality of channels configured to engage a plurality of lugs on the proximal end of the body to removably secure the head to the body.

For example and not limitation, a method of adjusting the energy of an inline muzzle loading firearm may comprise providing a modified breech plug with a distal end configured with a diverging propulsion gas nozzle, the nozzle having an end portion configured to engage a projectile, and a channel extending from the aperture to the diverging nozzle and configured to communicate propulsion gases from the cartridge to the end portion of the diverging nozzle. The modified breech plug may be installed in an inline muzzle-loading firearm. A first blank powder cartridge may be selected having predetermined energy characteristics configured to provide the firearm with a desired amount of energy for expelling a projectile. The first blank powder cartridge may be inserted in the modified breech plug. A second blank powder cartridge may be selected having predetermined energy characteristics different from the first blank powder cartridge. The first or second blank powder cartridge may be selected to produce an energy level in the firearm that mimics the energy level of a compressed gas weapon or other weapon or firearm.

For example, and not limitation, a modified inline muzzle loading firearm may comprise a barrel having a predetermined projectile location within the barrel when the barrel is muzzle loaded with powder, and a removable breech plug. The plug may have a body with a proximal end and a distal end. The proximal end may have an aperture configured to receive a blank powder cartridge. The distal end may be configured with a diverging propulsion gas nozzle, and may have an end portion configured to contact a projectile. A channel may extend from the aperture to the nozzle and may be configured to communicate propulsion gases from the cartridge to the end portion of the nozzle. The body may have an axial length such that when the projectile engages the end portion of the diverging nozzle, the projectile is located in the barrel at substantially the same location as the predetermined projectile location. A gas seal may be disposed between the body and an inside surface of the barrel. The seal may comprise an elastomeric O-ring, and may further comprise an O-ring groove adjacent the distal end of the body. A relief may be provided adjacent the aperture configured to facilitate removal of a cartridge from the aperture. A removable head may have a firing pin that is centered about the aperture when the removable head is attached to the proximal end of the body. The breech plug may be configured to accept a center fire blank powder cartridge or a rim fire blank powder cartridge.

The inventions disclosed herein provide benefits over the prior art, including, but not limited to, a cleaner shooting experience when smokeless powder is used; a lighter, quicker and quieter loading and shooting experience when low energy cartridges are used; the ability to convert a conventional muzzle lodging firearm into an equivalent a big-bore pre charged pneumatic (PCP) gun with enough power to hunt up to medium game; the ability to convert a conventional muzzle loading firearm into an equivalent gas-pressure propelled crossbow/compound bow bolt/arrow; the ability to convert a conventional muzzle loading firearm into fishing harpoon; and the ability to use the ramrod supplied with the firearm by the firearm manufacturer.

The inventions disclosed herein provide benefits over the prior art, including, but not limited to, simplifying the process of charging the muzzleloader with powder. There are no mistakes in the measurement of gunpowder loaded through the muzzle, no differences of projectile speed or trajectory due to inexactness of measurement of the powder, or differences in ignition or combustion due to different sizing of the powder grain. Moreover, the inventions disclosed herein place the projectile at the same barrel location as a conventional muzzle loading firearm. Each and all of these benefits increase the accuracy and repeatability of the firearm.

While this disclosure uses long guns to describe how to make and use the subject inventions, it must be understood that our inventions are not limited to long guns, but apply equally to hand guns and all other manner of firearm and projectile weapon.

Turning now to more detailed descriptions of how to practice our inventions, FIG. 1 illustrates a conventional inline muzzle-loading rifle 100 comprising a barrel 102 with a muzzle end 104 and a breech end 106. Also illustrated is a removable breech plug 108. It will be appreciated by those of skill in this art that breech plug 108 may be screwed into barrel 102. Thereafter, loose or pelletized powder (not shown) may be introduced into the barrel 102 from the muzzle end 104, and the associated ramrod 110 may be used to pack the powder charge against the breech plug 108. Next, a projectile, such as a ball, bullet or sabot (not shown), may be introduced into the barrel 102 from the muzzle end 104, and the associated ramrod 110 may be used to pack the projectile against the powder charge. A primer cap (not shown), such as a #10 or #11 percussion cap, a musket cap, a Winchester 209 primer, a Federal 209A primer, or a CCI 209 Magnum primer, may be loaded into a receptacle in the proximal end of the breech plug 108. Pulling the trigger 112 causes a hammer (not shown) to strike the end of the primer cap, which causes a flame or spark to traverse a small diameter flame path in the breech plug 108 to ignite the powder thereby expelling the projectile from the barrel 102.

Figure 2:
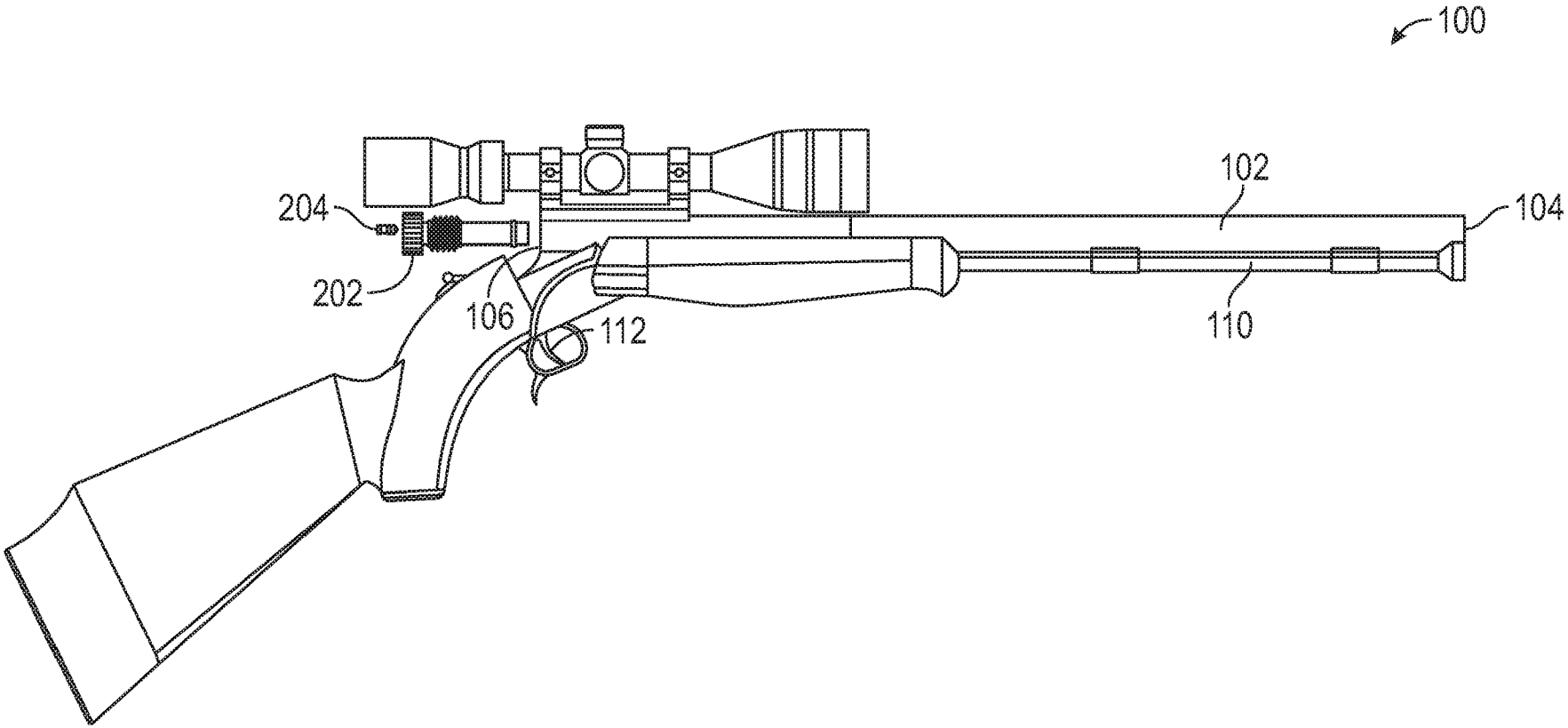
FIG. 2 illustrates the inline muzzle-loading rifle shown in FIG. 1 with a removable breech plug according to the present inventions.

FIG. 2 illustrates the conventional inline muzzle loading rifle 100 of FIG. 1 outfitted with an embodiment of an improved breech plug 200 according to the present inventions. As will be described in more detail below, the improved breech plug 200 does not use a primer cap to ignite muzzle-loaded powder. Rather, the improved breech plug 200 is configured to receive in the proximal end a blank powder cartridge. In this disclosure, we use the word "blank" to mean the cartridge does not have a projectile associated with the cartridge. Similarly, we use the phrase "powder cartridge" to mean a sealed cartridge or shell of ballistic powder with associated primer configured to be loaded into a cartridge receptacle in the proximal end of the breech plug 200. A blank powder cartridge 204 is illustrated in FIG. 2 and does not have a projectile associated with the cartridge. It now will be understood that the improved breech plug 200 does not contain a flame or flash path like that contained in conventional breech plug 108. Rather, breech plug 200 comprises a pressure or gas channel configured to communicate propelling gases from the cartridge 204 to a distal end of the breech plug 200. In other words, the improved breech plug 200 does not require, and preferably does not allow, ballistic powder, such as black powder, to be loaded from the muzzle end 104, and packed against the distal end of the breech plug 202. Rather, ballistic powder is loaded from the breech end in the form of the blank powder cartridge 204.

In use, a projectile (not shown) may be loaded into the barrel 102 through the muzzle end 104, and the ramrod 110 may be used to contact, and preferably, seat the projectile against the distal end of breech plug 202. It will be appreciated that configuring the distal end of the breech plug 202 to seat or engage the projectile prevents or at least reduces the ability of the projectile to slip out of the barrel, and aids the transfer of energy to the projectile. Thereafter, a blank powder cartridge 202 may be loaded into the cartridge receptacle in the proximal end of the breech plug 200, the breech opening closed, and the rifle fired by pulling trigger 112.

Figure 3A:
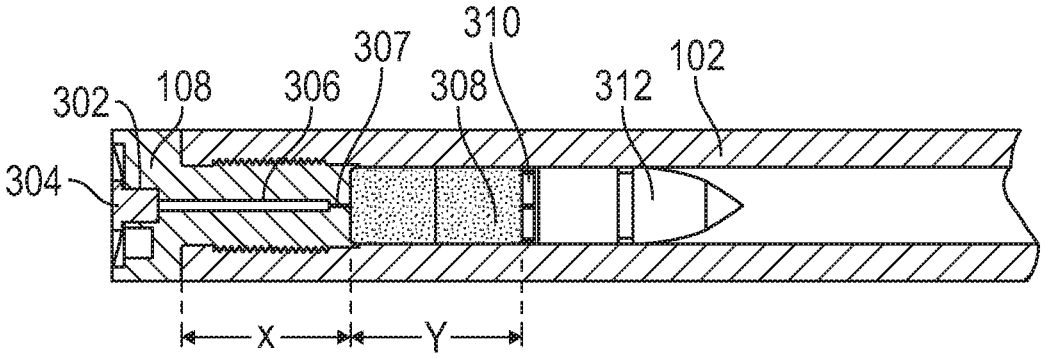
FIG. 3A (Prior Art)
FIGS. 3A, 3B, and 3C illustrate a comparison of relative component positions among breech plugs of the present inventions and conventional breech plugs.
Figure 3B:
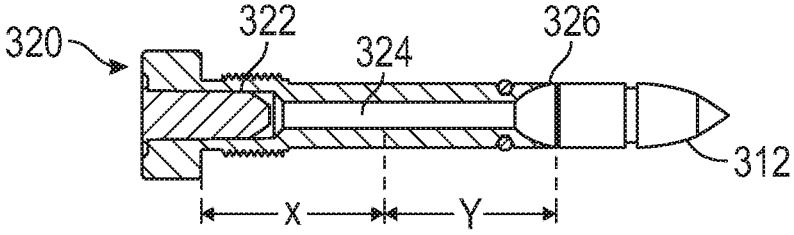
Figure 3C:
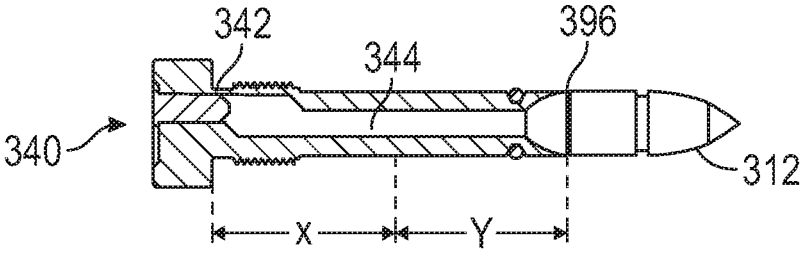

FIGS. 3A, 3B, and 3C illustrate a cross-sectional comparison between a conventional breech plug 108, and improved breech plugs of the present inventions. FIG. 3A illustrates a barrel 102 with breech plug 108 installed therein. The proximal end of breech plug 108 comprises a primer receptacle 302 into which a primer 304 has been loaded. Flash channel path 306 and flash hole 307 are shown communicating from the primer receptacle 302 to the distal end of the breech plug 108. Packed against the distal end is an amount of ballistic powder 308, in the form of pelletized powder. Packed against the powder 308 is a wad 310 and a projectile 312. As illustrated in FIG. 3A, the distal end of the breech plug 108 is located at a constant axial distance "x" from the breech end of the barrel 102. In contrast, it will be appreciated that the axial position of the projectile 312 in the barrel 102 is a function of the amount, and even the form, of powder 308 loaded into the barrel 102 from the muzzle 104, and how tightly packed the powder is against the breech plug 108. In a perfect world, the projectile 312 would be placed in substantially the same axial location in the barrel (e.g., "x"+"y") each time to provide some level of repeatability of ballistic dynamics, but this is not a reasonable expectation for muzzle loading firearms, especially when loaded with loose powder. However, this level of repeatability may be achieved with a breech plug modified according the inventions disclosed herein, and using a standard, manufacturer-supplied ramrod.

FIGS. 3B and 3C illustrate advantages of the improved breech plugs configured according to the present inventions. FIG. 3B illustrates a center fire breech plug 320, and FIG. 3C illustrates a rim fire breech plug 340. As can be understood from the figures, each of the improved breech plugs, 320, 340, comprises a cartridge receptacle 322, 342, and a gas channel 324, 344 configured to communicate propelling gases from the cartridge to the distal end 326, 346 of the breech plug 320, 340. The distal end 326, 346 of the breech plug 320, 340 preferably comprises a diverging nozzle against which or in which a projectile 312 may contact, engage, or seat. From these figures, it can be understood that the improved breech plugs of the present inventions are configured to locate the projectile 312 at substantially the same axial location in the barrel 102 as the projectile 312 in FIG. 3A (e.g., "x"+"y"). Whereas projectile placement in conventional muzzle loading firearms (such as FIG. 3A) varies with powder charge and packing, the improved breech plug 320, 340 allows the projectile 312 to be placed in the same barrel location each time using the standard ramrod supplied by the fire arm manufacturer for muzzle loading powder and projectile, thereby improving the ballistic dynamics of the firearm through increased repeatability.

Figure 4:
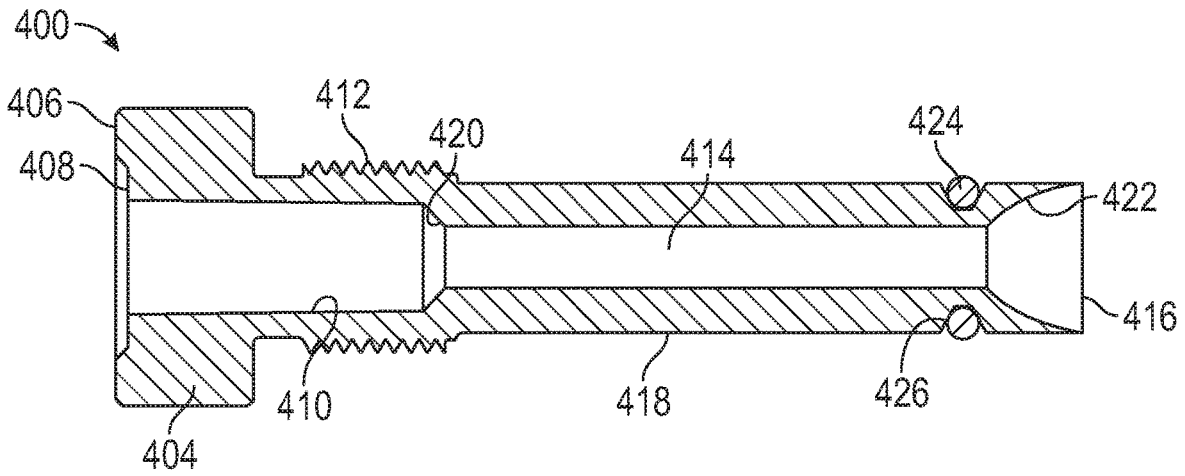
FIG. 4 illustrates a cross-sectional view of centerfire breech plug according to the present inventions.

FIG. 4 illustrates detail of an embodiment of a center fire breech plug 400 according to the present inventions. The breech plug 400 comprises a head 404 at a proximal end 406. The head 404 comprises a recess 408, preferably of circular shape, disposed about a cartridge bore or receptacle 410. It will be appreciated that the size and shape of head 404 will depend on the specific design of the inline muzzle-loading firearm. Continuous or discontinuous screw threads 412 may be disposed on an outer surface of the breech plug 400 and be configured to threadingly engage with corresponding threads in a barrel (not shown). The cartridge bore 410 transitions into a gas channel 414, configured to allow propelling gases from a cartridge (not shown) to efficiently travel to the distal end 416 of the breech plug 402. It is preferred that the diameter of the gas channel 414 be sized to optimize flow of the propelling gases such that drag or friction losses do not have a significant effect, thereby reducing energy loss in the propelling gases as they traverse the length of the gas channel. In practice, we have found that a gas channel having a diameter of between about 0.1875 inch to about 0.375 inch, and more preferably about 0.25 inch, provides acceptable results. Alternately, if it is desired to reduce the energy delivered to the projectile, the gas channel may be sized so that friction and other losses reduced the energy delivered by the powder cartridge to the projectile.

It now will be understood that the length of the breech plug 402 and/or the size, such as diameter, of the gas channel 414 may be designed to place the projectile (not shown) at a desired location, such as the location shown in FIGS. 3B and 3C, and to maximize or reduce, as desired, the energy applied to the projectile (not shown). Because the outer surface 418 of the breech plug 400 will be in contact the inner surface of the barrel (not shown), such as barrel rifling, the wall thickness between the gas channel 414 wall and the outer wall 418 may be sized to optimize the size of the gas channel 414 without compromising the structural integrity of the breech plug 400. Conversely, the size of the gas channel 414 can be minimized to adjust the propelling energy delivered to the projectile. The wall thickness of the breech plug 400 surrounding the cartridge bore 410 should be thick enough to support the threads and contain the energy of the cartridge. The breech plug 400 may or may not include a bullet stop 420 as a safety feature. While the inventions herein contemplate a projectile-less blank powder cartridge, a bullet stop, such as chamfered shoulder 420 would prevent discharge of a projectile from a barrel, if a live cartridge were inadvertently loaded in the breech plug 400.

Focusing on distal end 416 of breech plug 400, it is presently preferred that the end 416 comprise a diverging nozzle 422 so that the propelling gases can expand to contact the entire face of the projectile (not shown). Also shown adjacent the distal end 416 is seal 424 seated in seal groove 426. Seal 424 may be an O-ring type seal, and is preferably formed from a high-temperature material that will seal the breech plug 402 against the inside of the barrel (e.g., against the lands and grooves of the rifling) and prevent propelling gases from leaking past the seal 424. The distal end 416 may be configured to engage, seat, seal or otherwise hold a projectile, or portion of a projectile. For example, the ramrod associated with the firearm can be used to engage, seat, or seal the projectile to the distal end. Alternately, the projectile may merely contact or sit on the distal end. Still further, a portion of the projectile may be configured to engage, seat, or seal against the distal end.

Figure 5:
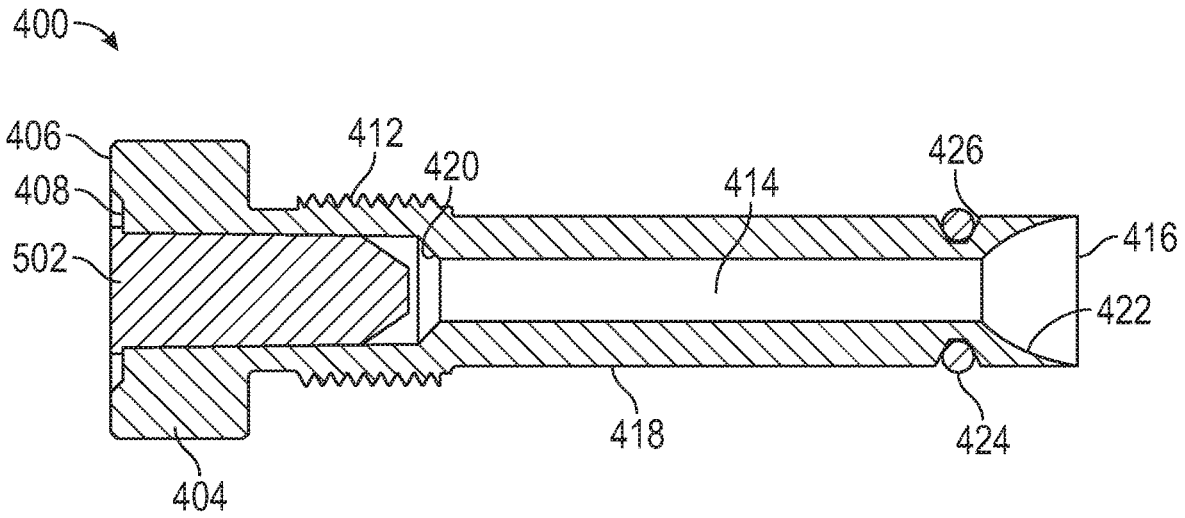
FIG. 5 illustrates the breech plug of FIG. 4 with a centerfire powder cartridge.

FIG. 5 illustrates the breech plug 400 of FIG. 4 with a center fire blank powder cartridge 502 loaded in the cartridge bore 410. It will be understood that the cartridge bore or chamber 410 is sized such that when the outer diameter of the cartridge 502 increases or swells during firing, the outer cartridge wall seals against the cartridge chamber 410 wall. Thus, the distal seal 424 and the cartridge bore 410 cooperate to provide a propelling gas sealing system.

Figure 6:
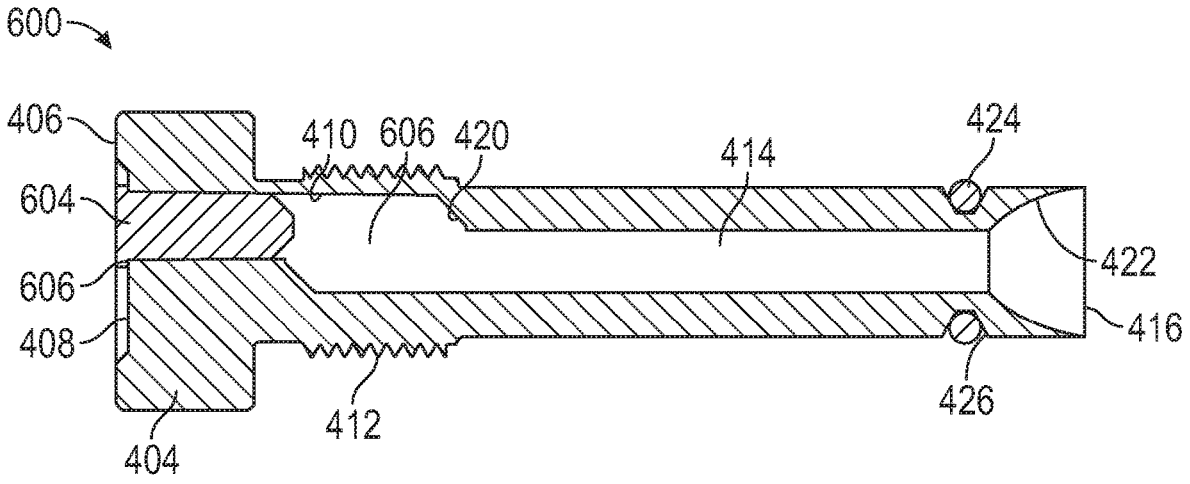
FIG. 6 illustrates a cross-sectional view of rim fire breech plug according to the present inventions.

FIG. 6 illustrates a rim fire breech plug 600 according to the present inventions. The description of components common to breech plug 402 of FIG. 4 apply to those common structures shown in FIG. 6. It will be appreciated that because breech plug 600 uses a rim fire blank powder cartridge 604, the cartridge receptacle or bore 410 may be offset from the centerline of the breech plug 600 so that the firearm hammer can strike the rim 606, rather than the center, of the cartridge 604. Preferably, a portion of the rim 606 is aligned with the centerline of the breech plug 600. It is desired, but not required, that the propelling gases from the cartridge 604 contact the projectile (not shown) equally across the projectile face. Thus, it is preferred, but not required, that an offset or transition 606 exist between the cartridge bore 410 and the gas channel 414, and that the gas channel 414 be centered substantially about the breech plug 600 centerline. Although the transition 606 in FIG. 6 is illustrated to be immediately distal of the cartridge 604, it will be understood that the transition may be located at any position along the axial length of the breech plug 600. For example, but not limitation, the gas channel may start out aligned with the cartridge aperture (with or without bullet stops) and then angle toward the centerline of the nozzle. It also will be understood that embodiments may be configured in which there is no transition 606, with the effect that that the gas channel 414 is offset from the centerline of the breech plug 600. In such embodiments, modification of the seal groove 426 may be required.

Figure 7:
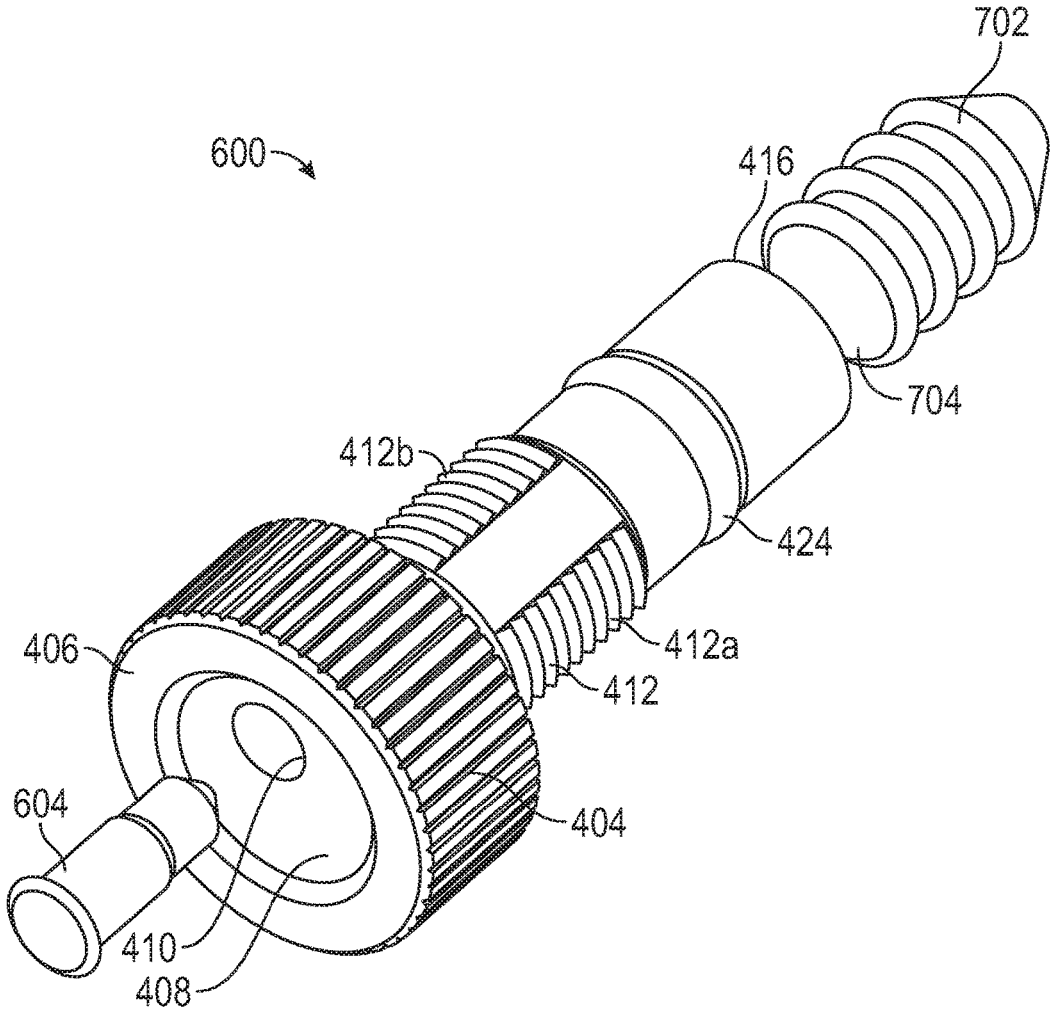
FIG. 7 illustrates an exploded view of a rim fire breech plug according to the present inventions.

FIG. 7 is a perspective of an embodiment of the breech plug 600 illustrated in FIG. 6, and includes a projectile 702 comprising a projectile face 704. Also illustrated are discontinuous screw threads 412. Thread system 412 may be referred to as a quarter thread in the sense that there are four sets of threads 412*a*, 412*b*, 412*c* and 412*d*, although on sets 412*a* and 412*b* are shown. It will be understood that the thread sets are equally spaced about the outside surface of the breech plug 602. This type of quick turn thread system, as well as other types of connection systems, can be employed on rim fire breech plugs to ensure that the cartridge bore 410 is clocked to the right location. These thread systems also can be used on center fire breech plugs, such as the embodiments illustrated in FIGS. 4 and 5.

Figure 8:
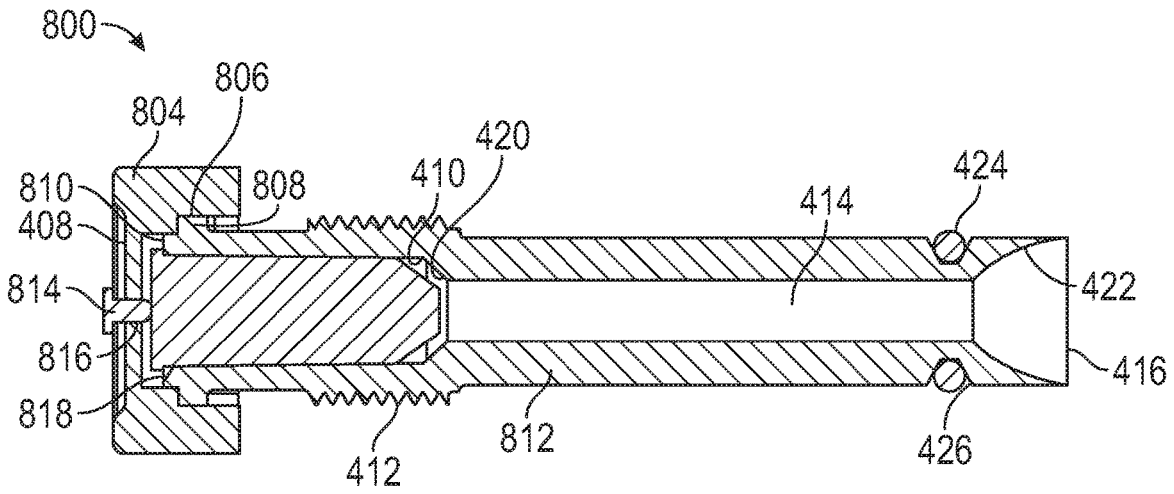
FIG. 8 illustrates a cross-sectional view of an alternate embodiment of a breech plug according to the present inventions.

FIG. 8 illustrates another embodiment of a breech plug 800 according to the present inventions. It will be understood that while the specific embodiment in FIG. 8 is a for a center fire blank powder cartridge 502, embodiments are contemplated for rim fire blank powder cartridges 604. The embodiment illustrated in FIG. 8 is similar to the breech plug 402 illustrated and described in FIGS. 4 and 5, except that breech plug 802 has a removable head 804. Removable head 804 may comprise a plurality of interior channels or grooves 806 that are configured to cooperate with lugs or ears 808 formed on the proximal end 810 of the breech plug body 812. It will be understood that these grooves 806 allow the removable head 804 to be axially inserted onto the proximal end 810 of the body 812, and then the head 804 rotated clockwise or counter clockwise, as desired or designed, to lock the head 804 to the body 812. Similar to breech plug heads previously described, the head 804 may have a recessed area 408. Unlike previous heads, head 804 may comprise a firing pin 814 configured to axially translate in a firing pin groove 816 formed in the head 814. It is preferred that that the firing pin 814 have one or more protuberances (not shown) that prevent the firing pin 814 from dislodging from head 814. Lastly, the proximal end 810 of body 812 is shown with a relief 818 formed in the end, and configured to facilitate easy removal of cartridge 502, such as by a fingernail. It will be understood that relief 818 may be used with any of the foregoing breech plugs, as well as other breech plugs incorporating the present inventions.

Figure 9:
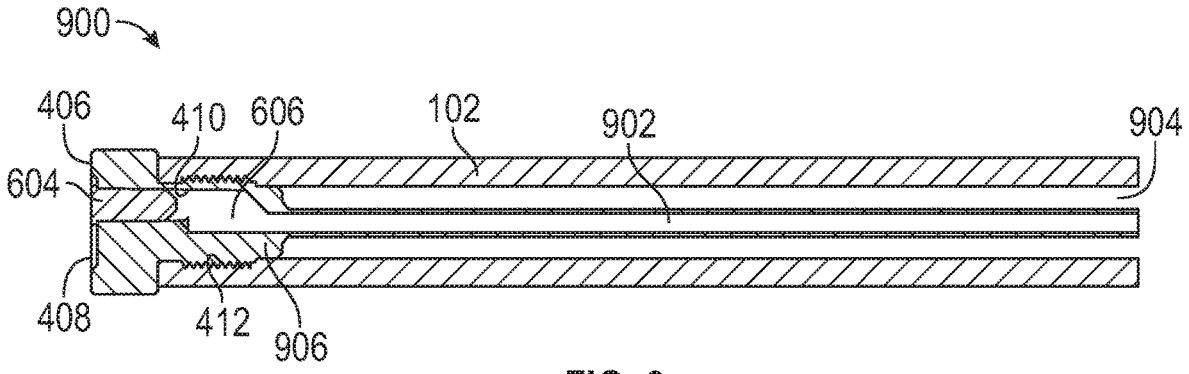
FIG. 9 illustrates a cross-sectional view of an embodiment suitable for use with hollow arrows or dart projectiles.

FIG. 9 illustrates yet another embodiment of a breech plug according to the present inventions useful with arrows or darts (not shown) as projectiles. Breech plug 900 is similar to the rim fire breech plug 600 illustrated and described in FIG. 6. However, rather than having a gas channel 414 whose outside surface contacts the inside surface of barrel 102, this embodiment has an elongated gas channel 902 that extends substantially the length of the barrel 102, and forms and annular gap 904 between the outer surface of the gas channel 902, and the inner surface of the barrel 102. It will be understood by those of skill in the art that a hollow arrow or dart may be loaded from the muzzle end of the barrel 102, sliding along the outside surface of gas channel 902 with a proximal end of the arrow or dart adjacent the breech plug body 906. In this embodiment, the projectile face against which the propelling gases act is adjacent the distal end of the arrow or dart, which will be adjacent the distal end of the barrel 102. Although a rim fire breech plug is illustrated, persons of skill will appreciate that a center fire breech plug with elongated gas channel may be used for arrow and darts. Alternately, for those arrows or darts that seal against the breech plug, any of the previously described breech plugs 320, 340, 400, 600, 800 may be used.

Figure 10:
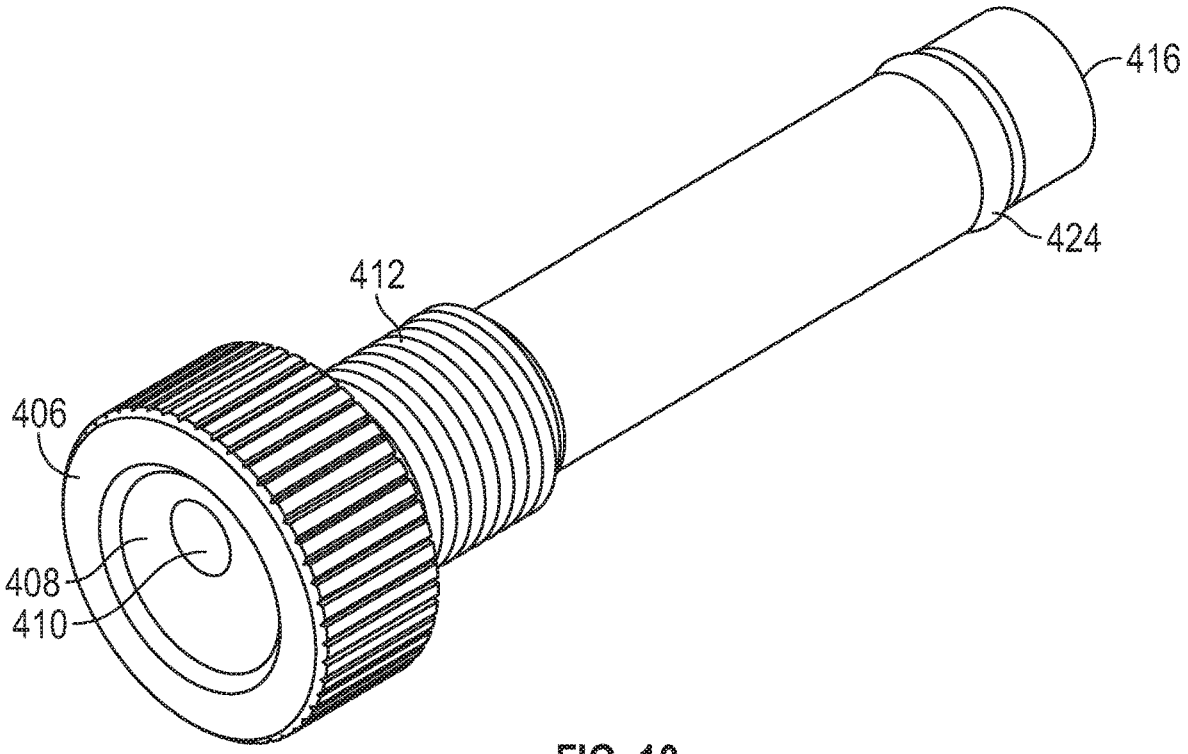
FIGS. 10, 11, 12, and 13 illustrate embodiments suitable for use with a variety of inline muzzle loading firearms.
Figure 11:
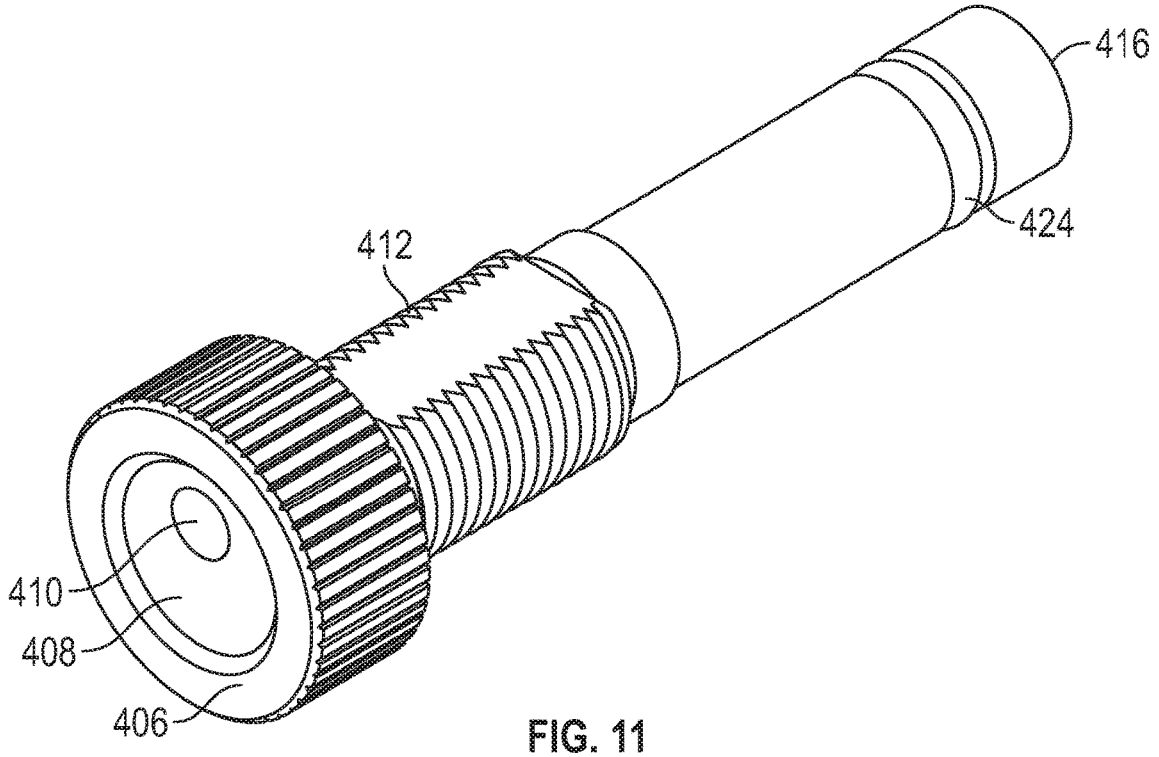
Figure 12:
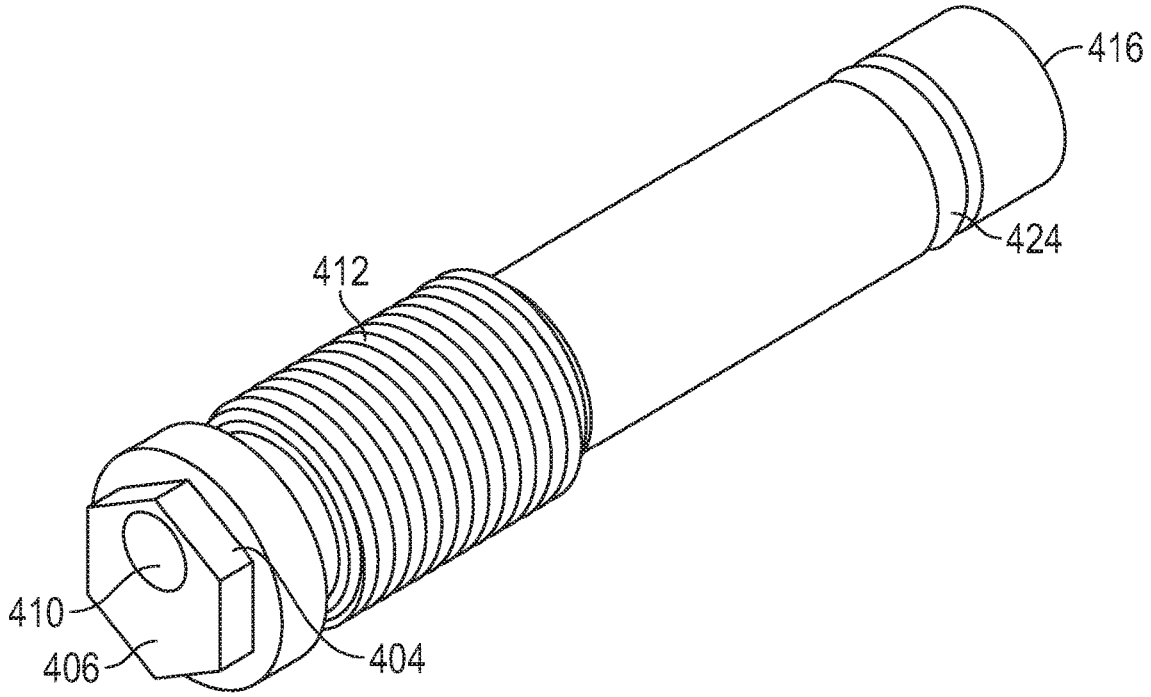
Figure 13:
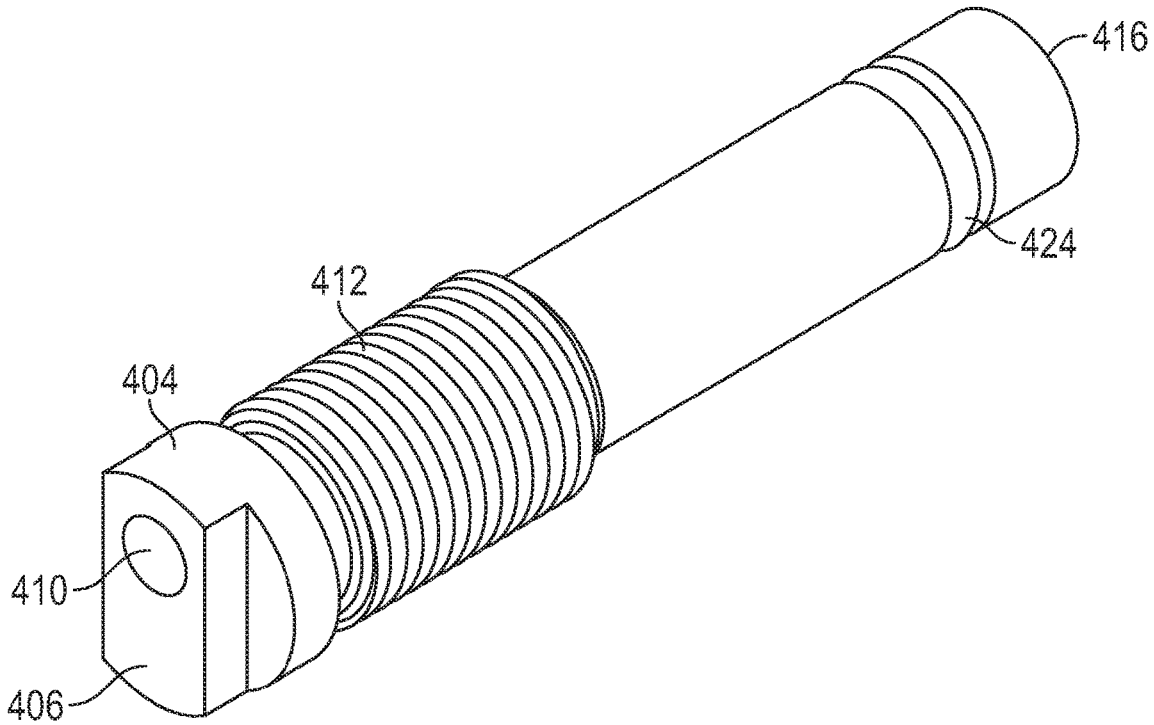

FIG. 10 illustrates a breech plug according to the present inventions configured for CVA brand inline muzzle loading rifles. FIG. 11 illustrates a breech plug according to the present inventions configured for T/C brand Triumph® and Bone Collector® inline muzzle loading rifles. FIG. 12 illustrates a breech plug according to the present inventions configured for T/C brand Impact®, Encore®, and Omega® inline muzzle loading rifles. FIG. 13 illustrates a breech plug according to the present inventions configured for Traditions brand inline muzzle loading rifles.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A breech plug for modifying an inline muzzle-loading firearm to receive a blank powder cartridge, the firearm comprising a barrel having a predetermined projectile location, the breech plug comprising:

a plug body having a proximal end and a distal end;

the proximal end having an aperture configured to receive the blank powder cartridge;

the distal end configured with a diverging propulsion gas nozzle, and having an end portion configured to contact a projectile at the predetermined projectile location;

a channel extending from the aperture to the diverging nozzle and configured to communicate propulsion gases from the cartridge to the end portion of the diverging nozzle, wherein the channel diameter is less than both the aperture diameter and the nozzle diameter;

wherein the inside surface of the barrel comprises rifling, and wherein the body extends into and seals against the barrel rifling, and wherein the body has an axial length such that when the projectile contacts the end portion of the diverging nozzle, the projectile is located in the barrel at the predetermined projectile location.

2. The breech plug of claim 1, further comprising a gas seal configured to seal between the body and the inside surface of the barrel.

3. The breech plug of claim 2, wherein the seal comprises an elastomeric O-ring, and further comprising an O-ring groove adjacent the distal end of the body.

4. The breech plug of claim 2, wherein the breech plug is configured to accept a center fire blank powder cartridge.

5. The breech plug of claim 2, wherein the breech plug is configured to accept a rim fire blank powder cartridge.

6. The breech plug of claim 5, wherein the channel is located about a centerline of the body and the aperture is offset from the centerline.

7. The breech plug of claim 5, wherein the channel is located about a centerline of the body and the aperture is offset from the centerline.

8. The breech plug of claim 6, wherein the plug is clocked relative to the barrel such that the aperture located at a hammer strike position.

9. The breech plug of claim 2, further comprising a relief adjacent the aperture and configured to facilitate removal of a cartridge from the aperture.

10. The breech plug of claim 2, further comprising a projectile stop located between the aperture and the channel.

11. The breech plug of claim 1, further comprising a removable head having a firing pin that is centered about the aperture when the removable head is attached to the proximal end of the body.

12. A modified inline muzzle loading firearm comprising:

a barrel having a predetermined projectile location within the barrel;

a removable breech plug having a body with a proximal end and a distal end;

the proximal end having an aperture configured to receive a blank powder cartridge;

the distal end configured with a diverging propulsion gas nozzle, and having an end portion configured to contact a projectile at the predetermined projectile location;

a channel extending from the aperture to the diverging nozzle and configured to communicate propulsion gases from the cartridge to the end portion of the diverging nozzle, wherein the channel diameter is less than both the aperture diameter and the nozzle diameter; and a gas seal disposed between the body and the inside surface of the barrel;

wherein the inside surface of the barrel comprises rifling, and wherein the body extends into and seals against the barrel rifling, and wherein the body has an axial length such that when the projectile contacts the end portion of the diverging nozzle, the projectile is located in the barrel at the predetermined projectile location.

13. The firearm of claim 12, wherein the seal comprises an elastomeric O-ring, and further comprising an O-ring groove adjacent the distal end of the body.

14. The firearm of claim 12, further comprising a relief adjacent the aperture and configured to facilitate removal of a cartridge from the aperture.

15. The firearm of claim 12, further comprising a removable head having a firing pin that is centered about the aperture when the removable head is attached to the proximal end of the body.

16. The firearm of claim 12, wherein the breech plug is configured to accept a center fire blank powder cartridge.

17. The firearm of claim 12, wherein the breech plug is configured to accept a rim fire blank powder cartridge.

* * * * *